United States Patent [19]

Rector et al.

[11] Patent Number: 4,837,866

[45] Date of Patent: Jun. 13, 1989

[54] SHOCK ATTENUATION TENSION MOUNTING FOR FACE GUARD

[75] Inventors: James L. Rector, Vienna; Robert M. Zide, Williamstown, both of W. Va.

[73] Assignee: Pro-Line, Inc., Marietta, Ohio

[21] Appl. No.: 219,777

[22] Filed: Jul. 18, 1988

[51] Int. Cl.[4] ..... A41D 13/00

[52] U.S. Cl. ..... 2/424

[58] Field of Search ..... 2/411, 414, 424, 425, 2/9

[56] References Cited

U.S. PATENT DOCUMENTS

| | | | |
|---|---|---|---|
| 3,106,716 | 10/1963 | Beebe | 2/9 |
| 3,139,624 | 7/1964 | Humphrey | 2/9 |
| 3,263,236 | 8/1966 | Humphrey | 2/9 |
| 3,729,746 | 5/1973 | Humphrey | 2/9 |
| 3,854,146 | 12/1974 | Dunning | 2/9 |
| 3,886,596 | 6/1975 | Franklin et al. | 2/9 |
| 4,086,664 | 5/1978 | Humphrey et al. | 2/9 |
| 4,363,140 | 12/1982 | Correale | 2/9 |
| 4,370,759 | 2/1983 | Zide | 2/424 |
| 4,633,531 | 1/1987 | Nimmons | 2/424 |

*Primary Examiner*—Werner H. Schroeder
*Assistant Examiner*—Douglas E. Price
*Attorney, Agent, or Firm*—Brady, O'Boyle & Gates

[57] ABSTRACT

A shock attenuation tension mounting for connecting a face guard to a helmet wherein a pair of looped straps are provided on each side of the helmet. Each pair of looped straps includes an inner relatively stretchable looped strap enclosing a wire segment of the face guard, and an outer, relatively stiff looped strap enclosing the inner loop. The inner looped strap allows controlled movement of the face guard toward the helmet with increasing resistance force for shock attenuation, and the outer strap limits the movement of the face guard toward the helmet, the amount of movement being controlled by the selection of relative loop lengths of the outer and inner straps.

18 Claims, 2 Drawing Sheets

FIG. 1
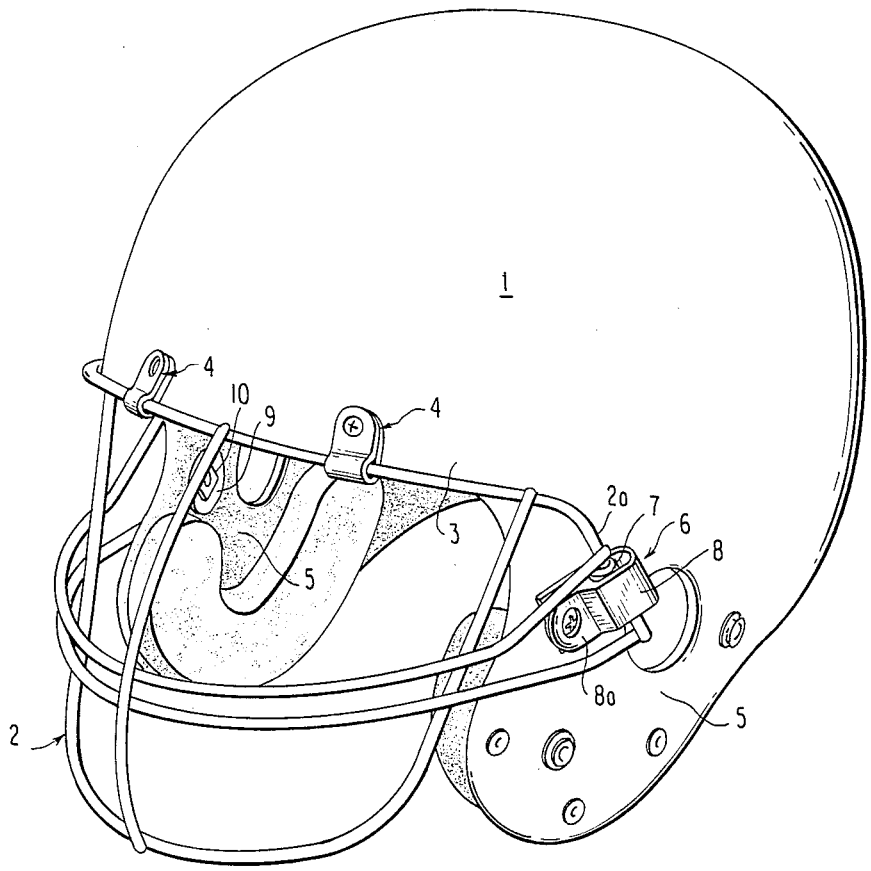
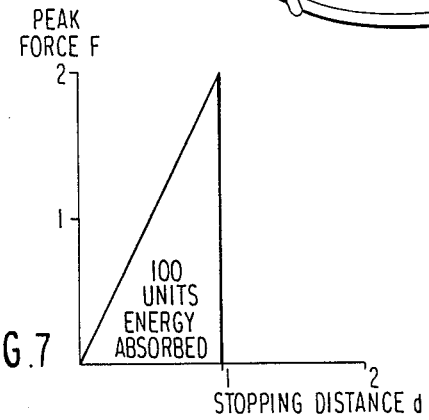
FIG. 7
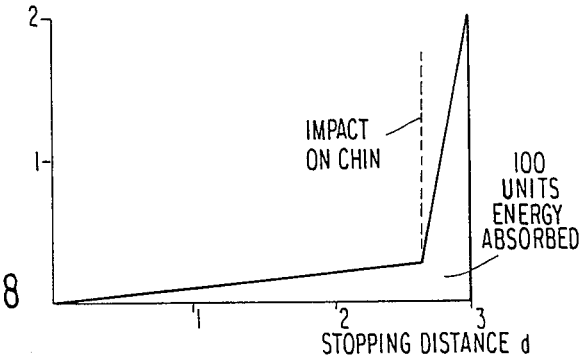
FIG. 8
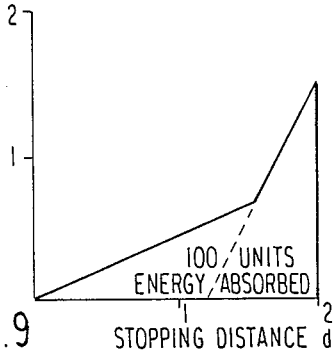
FIG. 9
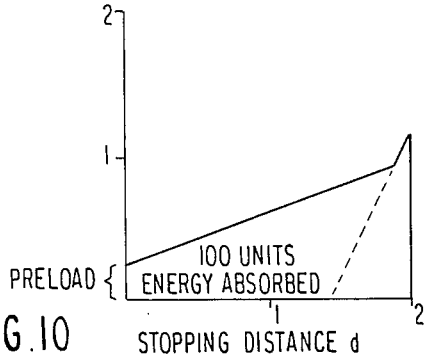
FIG. 10

SHOCK ATTENUATION TENSION MOUNTING FOR FACE GUARD

BACKGROUND OF THE INVENTION

U.S. Pat. No. 4,633,531 to Nimmons discloses a tension mounted face guard on a football helmet wherein a pair of resilient straps in the form of loop enclose wire segments of the face guard, the straps being secured to the vertical side portions of the helmet by suitable fasteners, whereby most of the shock force encountered by the face guard due to blows thereon is absorbed by the tension mounted straps.

Tests performed, in accordance with standards specified by the National Operating Committee on Standards for Athletic Equipment (NOCSAE), on face guards secured to the helmet by the single strap side connectors of the type disclosed in the abovementioned Nimmons patent, showed that the faceguard may contact the wearer's face due to either of two faults; namely, (1) Excessive softness or resilience of the strap permits movement of the faceguard into the face.

(2) Excessive stiffness or rigidity of the strap transmits high impact force to the helmet causing it to rotate on the wearer's head resulting in facial contact with the faceguard.

Therefore, from the tests, it was determined that a single component strap selected for one extreme of compact blows will fail to provide suitable protection over the entire range of impact blows.

After considerable research and experimentation, the shock attentuation tension mounting of the present invention has been devised as an improvement on the tension mounting of the type disclosed in the aforementioned Nimmons patent, and comprises, essentially, a pair of looped straps on each side of the helmet, wherein an outer, relatively stiff looped strap encloses an inner, relatively stretchable looped strap which encloses wire segments of the face guard, the pair of looped straps being secured to the side portions of the helment by suitable fasteners.

By this construction and arrangement, the inner strap allows controlled movement of the faceguard toward the helmet with increasing resistance force for shock attenuation, and the outer strap limits the movement of the faceguard toward the helmet and resists breakage at maximum impact force from a frontal blow, the amount of movement being controlled by the selection of relative loop lengths of the outer and inner straps.

BRIEF DESCRIPTION OF THE DRAWINGS

FIG. 1 is a perspective view of the shock attenuation tension mounting of the present invention securing a faceguard to the vertical side portions of a helmet;

FIG. 7 is a graph illustrating the effect of an impact of 100 units of energy, such as 100 lb.-ft., delivered frontally to a faceguard employing an excessive rigid or stiff strap connection resulting in a peak force being transmitted to the helmet and wearer's head and neck over a short stretch distance of the strap;

FIG. 8 is a graph similar to the graph of FIG. 7 but wherein an excessive soft or resilient strap is employed in the faceguard connection;

FIG. 9 is a graph of the peak force being transmitted to the helmet over the stretch distance employing the shock attenuation mounting of the present invention; and FIG. 10 is a graph similar to FIG. 9 wherein the inner loop is preloaded or pretensioned.

DESCRIPTION OF THE PREFERRED EMBODIMENTS

Figure 2:
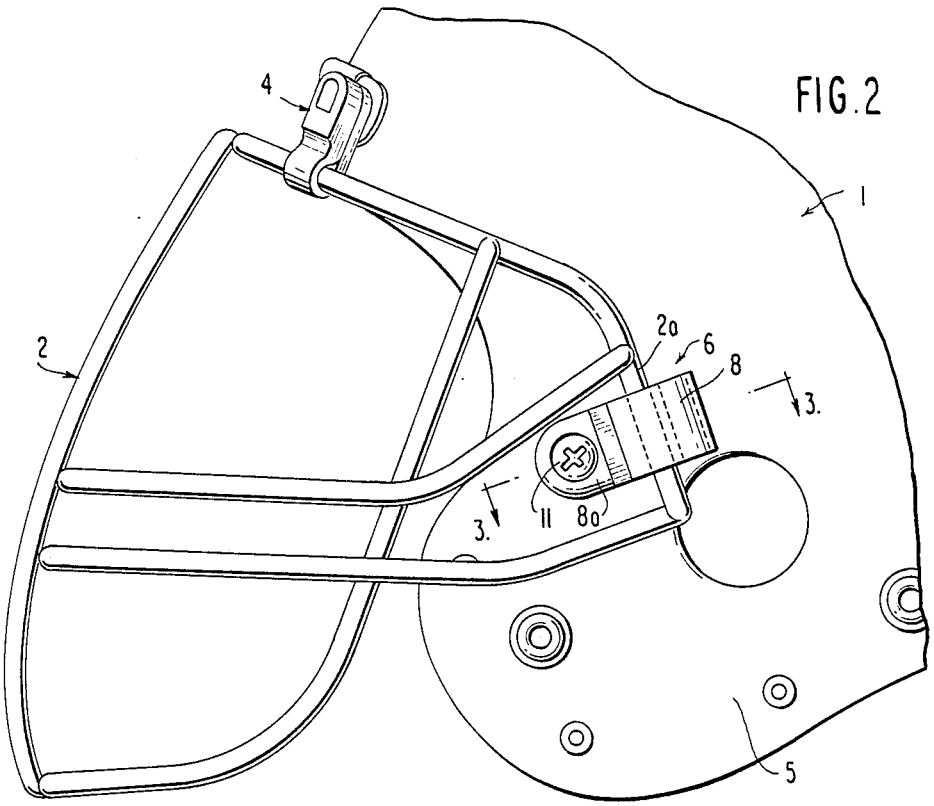
FIG. 2 is a side elevational view of the mounting shown in FIG. 1.

Referring to the drawings and more particularly to FIGS. 1 and 2, a football helmet 1 is provided with a conventional faceguard 2 secured to the top frontal edge portion 3 of the helmet by conventional mounting members 4, and to the vertical side ports 5 of the helmet by the shock attentuation tension mounting 6 of the present invention.

The details of the tension mounting 6 are illustrated in FIGS. 3 to 6, wherein it will be seen that a length of stretchable, resilient material 7 is provided having a planar lower surface *7a*, a relatively thin medial portion *7b* between relatively thick end portions *7c* having apertures *7d* provided therein. As will be seen in FIG. 3, the length of stretchable material 7 provides a strap adapted to be bent back on itself to form a loop enclosing a wire segment *2a* of the faceguard.

Figure 4:
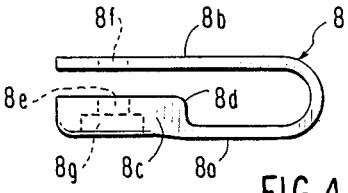
FIG. 4 is a side elevational view of the outer looped strap employed in the mounting of the present invention.
Figure 6:
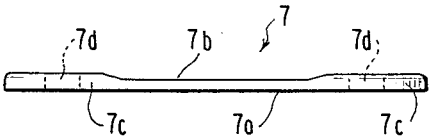
FIG. 6 is a side elevational view of the strap shown in FIG. 5.

Referring to FIG. 4, a plastic relatively stiff strap is molded to form a loop member 8 having spaced, parallel legs *8a*, *8b*. The end of leg *8a* is provided with a thick portion *8c* which forms a shoulder *8d* adjacent the end of the leg *8a*. The thick portion *8c* is provided with an aperture *8e* aligned with a similar aperture *8f* provided on the end of leg *8b*, the aperture *8e* also being counterbored as at *8g*.

Figure 3:
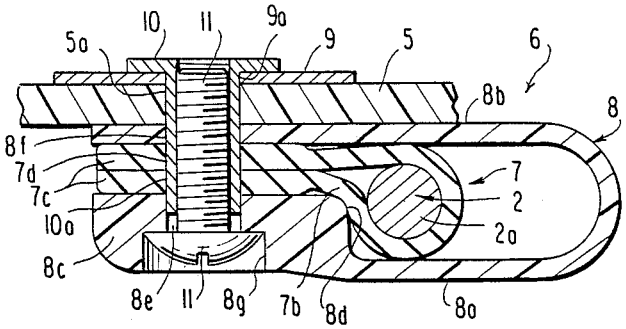
FIG. 3 is a view taken along line 3—3 of FIG. 2.
Figure 5:
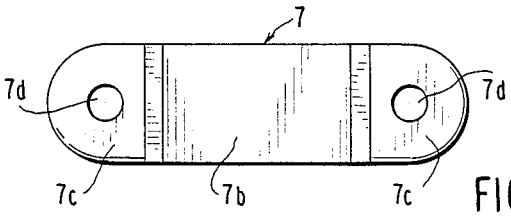
FIG. 5 is a plan view of the inner strap prior to being bent to looped form.

To assemble the mounting 6 on the helmet, as shown in FIG. 3, a washer 9 is placed against the interior wall of the side portion 5 of the helment with its aperture *9a* aligned with an aperture *5a* provided in the helmet side portion. A tee-nut 10 having an extended shank portion *10a* is inserted through the aligned apertures *9a* and *5a*. The loop member 8 is then connected to the tee-nut 10 by inserting the tee-nut through the aperture *8f* on leg *8b*. The outer leg *8a* of the loop member 8 is temporarily bent outwardly so that one end *7c* of the strap 7 forming the inner loop can be connected to the tee-nut 10 by aligning the aperture *7d* with the tee-nut shank *10a* and then sliding the end *7c* thereon. The strap 7 is then wrapped around the wire segment *2a* of the faceguard and bent back upon itself so that the opposite end of the strap can be slid onto the shank *10a* of the tee-nut. The planar lower surface *7a* at each end of the strap is now in face-to-face relationship. The outer leg *98a* is then bent inwardly whereby the end of tee shank *10a* is inserted into the aperture *8e* of the outer loop 8. The entire assembly is then secured to the helmet by inserting a bolt 11 into the tee-nut 10. By tightening the bolt 11, the shoulder *8d* engages the relatively thin portion *7b* of the inner loop 7, to thereby force the inner loop 7 and faceguard wire segment *2a* into a preload or tensioned position.

By the construction and arrangement of the tension mounting 6 of the present invention, the relatively resilient inner loop 7 allows movement of the faceguard 2 toward the helment 1 with increasing resistance force for shock attenuation, and the relatively stiff outer loop 8 limits the movement of the faceguard toward the helmet, the amount of movement being controlled by the selection of relative loop lengths of the outer and inner straps 8 and 7, respectively.

The shoulder 8*d* on the outer strap 8 engaging the inner strap 7 initially properly positions the faceguard on the helment, and by tightening the bolt 11, the shoulder 8*d* causes the inner strap 7 to stretch beyond its initial position to thereby preload or pretension the mounting 6. The preloading not only provides the advantage of reducing the peak transmitted force over a wide range of impacts but also eliminates looseness or rattle of the faceguard caused by dimensional fit requirements or by residual stretch from repeated impact.

The graphical representation shown in FIGS. 7 to 10 illustrate the effect of an impact delivered frontally to a faceguard secured to the helment by various attachments. FIG. 7 represents a faceguard employing an excessive stiff attachment, wherein movement of the faceguard is stopped within 1 unit of distance but a peak force of 2 units is delivered to the wearer's head.

FIG. 8 represents a faceguard employing such an excessive resilient attachment that the attachment stretches so far that the faceguard impacts on the chin. The attachment stretches approximately 3 units of distance and transmits 2 units of force to the wearer's head when the faceguard impacts on the chin.

FIG. 9 represents the shock attenuation tension mounting of the present invention wherein the inner loop 7 allows movement of the faceguard 2 toward the helmet 1 with increasing resistance force, the stretching of the inner loop 7 being limited by the outer loop 8, to thereby stop movement of the faceguard in 2 units of distance and transmitting 1.5 units of peak force to the wearer's head.

FIG. 10 represents the mounting of FIG. 9 wherein the inner strap 7 is preloaded whereby approximately 1.2 units of peak force is transmitted to the wearer's head in 2 units of distance.

From the above description, it will be appreciated by those skilled in the art that the shock attenuation mounting of the present invention reduces the amount of high peak forces delivered to the head than provided heretofore by known attachments or mountings, to hereby reduce the instances of concussion, neck injury, or displacement of the helment and facial contact with the faceguard.

The terms and expressions which have been employed herein are used as terms of description and not of limitation, and there is no intention, in the ue of such terms and expressions, of excluding any equivalents of the features shown and described or portions thereof but is is recognized that various modifications are possible within the scope of the invention claimed, including utilizing the inner looped strap in both pretensioned and untensioned states.

We claim:

1. A shock attenuation tension mounting for connecting a face guard to a helmet comprising, a pair of looped straps positioned on each side of the helmet, each pair of looped straps including an inner relatively stretchable looped strap enclosing a wire segment of the face guard, an outer, relatively stiff looped strap enclosing said inner looped strap, and fastener means extending through said straps and the sides of said helmet, whereby the inner strap allows controlled movement of the face guard toward the helment with increasing resistance force for shock attenuation, and the outer strap limits the movement of the face guard toward the helmet and resists breakage at maximum impact force from a frontal blow.

2. A shock attenuation tension mounting according to claim 1, wherein the inner looped strap comprises a length of stretchable, resilient material having a planar lower surface, a relatively thin medial portion, and thick end portions, aperture provided in said end portions, the length of material being bent back on itself to form a loop enclosing said face guard wire segment, the planar lower surface of the loop leg portions being in face-to-face relationship with the apertures in said end portions being aligned.

3. A shock attenuation tension mounting according to claim 2, wherein the outer looped strap comprises, a plastic relatively stiff strap mold to form a loop member having spaced, parallel legs, a thick portion provided on the end of one of the legs to thereby form a shoulder adjacent the end of said leg, an aperture provided in the end of one leg aligned with a similar aperture provided in the end of the other leg.

4. A shock attenuation tension mounting according to claim 3, wherein the fastener means extends through said aligned aperture in the inner and outer looped straps.

5. A shock atennuation tension mounting according to claim 4, wherein the fastener means comprises a tee-nut having an extended shank extending through said aligned apertures, and a bolt threaded into the tee-nut.

6. A shock attenuation tenson mounting according to claim 5, wherein the shoulder on one leg of the outer loop engages the relatively thin portion on one of the legs of the inner looped strap, whereby upon tightening the bolt, the shoulder forces the inner loop and face guard wire segment to a tensioned position.

7. A shock attenuation tension mounting according to claim 1, in which the loop lengths of said inner and outer straps are selected relative to each other to control the amount of movement of the face guard.

8. A shock attenuation tension mounting according to claim 1, wherein the inner looped strap comprises a length of stretchable, resilient material having end portions, apertures provided in said end portions, the length of material being bent back on itself to form a loop enclosing said face guard wire segment with the apertures in the end portions being aligned.

9. A shock attenuation tension mounting according to claim 1, wherein the outer looped strap comprises, a plastic relatively stiff strap molded to form a loop member having spaced, parallel legs, a thick portion provided on the end of one of the legs to thereby form a shoulder adjacent the need of said leg, an aperture provided in the end of one leg aligned with a similar aperture provided in the end of the other leg.

10. A shock attenuation tension mounting according to claim 1, wherein the outer loopd strap comprises, a plastic relatively stiff strap forming a loop member having spaced, parallel legs, said parallel legs each having an end portion, and an aperture in each said end portion aligned with each other.

11. A shock attenuation tension mounting according to claim 1, wherein the fastener means comprises, a tee-nut having an extended shank extending through said side of said helmet, inner looped strap and outer looped strap, and a bolt threaded into the tee-nut securing the said looped straps to the side of the helmet.

12. A shock attenuation tension mounting according to claim 1, in which said inner looped strap and outer looped strap extend rearwardly of the helmet from said fastener means, and said inner looped strap being normally in tension around said wire segment of the face guard.

13. A shock attenuation tension mounting according to claim 1, in which said inner looped strap is enclosed within said outer looped strap.

14. A shock attenuation tension mounting according to claim 1, in which said inner looped strap and outer looped strap each have top and bottom edges in substantial alignment.

15. A shock attenuation tension mounting according to claim 1, in which said inner looped strap is pretensioned to normally urge the wire segment of the face guard toward said fastener means, and said face guard away from said helmet.

16. A shock attenuation tension mounting according to claim 1, in which said inner looped strap is constructed of polyurethane.

17. A shock attenuation tension mounting according to claim 9, in which said shoulder protrudes interior of said outer looped strap.

18. A shock attenuation tension mounting according to claim 1, in which the outer looped strap is substantially greater in length than the length of the inner looped strap, whereby a movement space is provided interior of the inner looped strap between the ends of the inner looped strap and said outer looped strap.

* * * * *